United States Patent [19]

Peterson

[11] 4,252,200

[45] Feb. 24, 1981

[54] SAMPLING DEVICE

[76] Inventor: James R. Peterson, R#1, Box 121, Wilton, Calif. 95693

[21] Appl. No.: 12,735

[22] Filed: Feb. 16, 1979

[51] Int. Cl.[3] ..... E21B 7/26

[52] U.S. Cl. ..... 175/20; 175/58; 73/425.2

[58] Field of Search ..... 175/20, 58, 77, 308, 175/312, 272, 276, 277, 280, 292, 283, 291; 173/151, 425.2

[56] References Cited

U.S. PATENT DOCUMENTS

| | | | |
|---|---|---|---|
| 1,635,340 | 7/1927 | Perry et al. | 175/77 |
| 2,454,952 | 11/1948 | Starkey et al. | 73/151 X |
| 2,681,795 | 6/1954 | Gregory | 175/309 |
| 2,688,877 | 9/1954 | Peine | 73/425.2 |
| 2,896,444 | 7/1959 | Forman et al. | 73/425.2 |
| 3,085,636 | 4/1963 | Bennett et al. | 175/77 |

FOREIGN PATENT DOCUMENTS

| | | | |
|---|---|---|---|
| 634680 | 8/1936 | Fed. Rep. of Germany | 175/20 |
| 458384 | 10/1913 | France | 175/20 |

*Primary Examiner*—James A. Leppink
*Assistant Examiner*—Richard E. Favreau
*Attorney, Agent, or Firm*—Watson, Cole, Grindle & Watson

[57] ABSTRACT

Disclosed is a device for obtaining a plurality of samples from mineral deposits such as placer deposits to determine the presence of valuable metals. The device comprises a tubular member having a plurality of windows extending along its longitudinal axis and having a tapered point at one end, and a rotatable shaft within the tubular member having a plurality of compartments capable of aligning with the windows of the tubular members upon appropriate rotation of the shaft relative to the tubular member, each compartment having at least one spring-like tooth capable of extending from the compartment and through a window when the compartments and windows are aligned. The device may further include a pounder for driving the tubular member into a deposit.

9 Claims, 6 Drawing Figures

SAMPLING DEVICE

BACKGROUND OF THE INVENTION

The present invention is generally directed to devices useful in prospecting for valuable metals or minerals and, more specifically, to devices for sampling placer deposits to determine the presence of such valuable metals or minerals.

Placer deposits of various metals or minerals such as gold are fairly widespread in occurrence throughout portions of the world. These deposits generally comprise sand, gravel and other alluvium and eluvium containing concentrations of metals or minerals of economic importance and are the result of natural mechanical concentration wherein the heavy, chemically resistant and tough minerals are separated by gravity from the light and friable materials. The most economically important placer deposits generally are those formed by the action of streams where the flow of water creates placer deposits on the inside of meander bends of the stream.

In prospecting for the economically valuable concentrations of minerals or metals within a placer deposit, it has been the general practice to sample the deposit at various spaced locations in a uniform grid pattern by one or more methods such as shaft sinking, caisson sinking, churn drilling, open cuts and the like. However, for the amateur or weekend prospector who has limited time, manpower and equipment, these methods for sampling placer deposits are not generally feasible in terms of time and effort. Therefore the need exists for a small yet rugged device for sampling placer deposits which can normally be operated by one person and which can provide accurate and valuable information as to the composition of a particular portion of a deposit.

Devices for obtaining samples of earth are known in the art. For example, U.S. Pat. No. 507,018 to Lacy, U.S. Pat. No. 1,862,339 to Highmark, U.S. Pat. No. 2,454,952 to Starkey, and U.S. Pat. No. 3,036,638 to Parsons disclose such devices. In addition, probe-like devices for obtaining samples of flowable particulate solids such as grain are known from U.S. Pat. Nos. 230,121 to Frost and 1,087,847 to Graunfels, among others. However, none of the above-mentioned patents teach a device having the necessary structure and operation so as to be adapted for use in simultaneously obtaining a plurality of samples from mineral deposits such as placer deposits in a simple and efficient manner.

SUMMARY OF THE INVENTION

It is therefore a primary object of the present invention to provide a device adapted for the sampling of placer or other mineral deposits.

A further object of the present invention is to provide a device capable of obtaining a plurality of samples simultaneously from a mineral deposit.

Another object of the present invention is to provide a sampling device which can be easily operated by one person.

A further object of the present invention is to provide a device which is capable of simultaneously sampling a deposit at varying depths.

Yet another object of the present invention is to provide a sampling device which includes means for dislodging packed material within a placer deposit so as to facilitate recovery of samples.

Briefly, in its broader aspects, the present invention comprehends a sampling device adapted for use in obtaining samples of mineral deposits, the device comprising a tubular member having a plurality of windows extending along its longitudinal axis and a tapered point at one end, and a rotatable shaft within the tubular member having a plurality of compartments capable of alignment with the windows of the tubular member, each compartment having at least one spring-like tooth capable of extending from the compartment and through a window when the compartments and windows are aligned.

Further objects, advantages and features of the present invention will become more fully apparent from a detailed description of the arrangement and construction of the constituent parts as set forth in the following description taken together with the accompanying drawing.

DETAILED DESCRIPTION OF A PREFERRED EMBODIMENT

Figure 1:
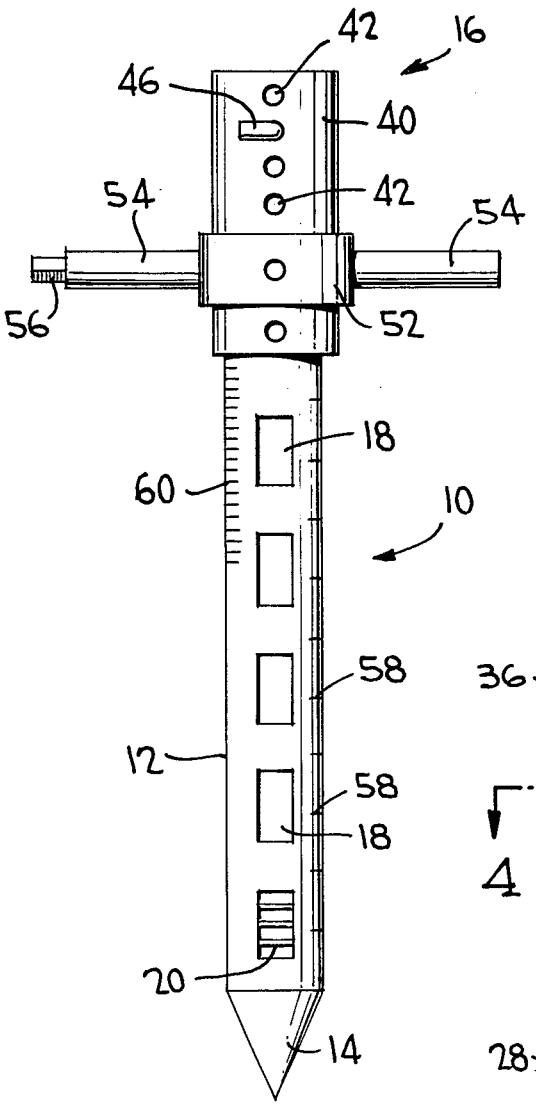
FIG. 1 is a side view of the sampling device in accordance with the present invention.
Figure 2:
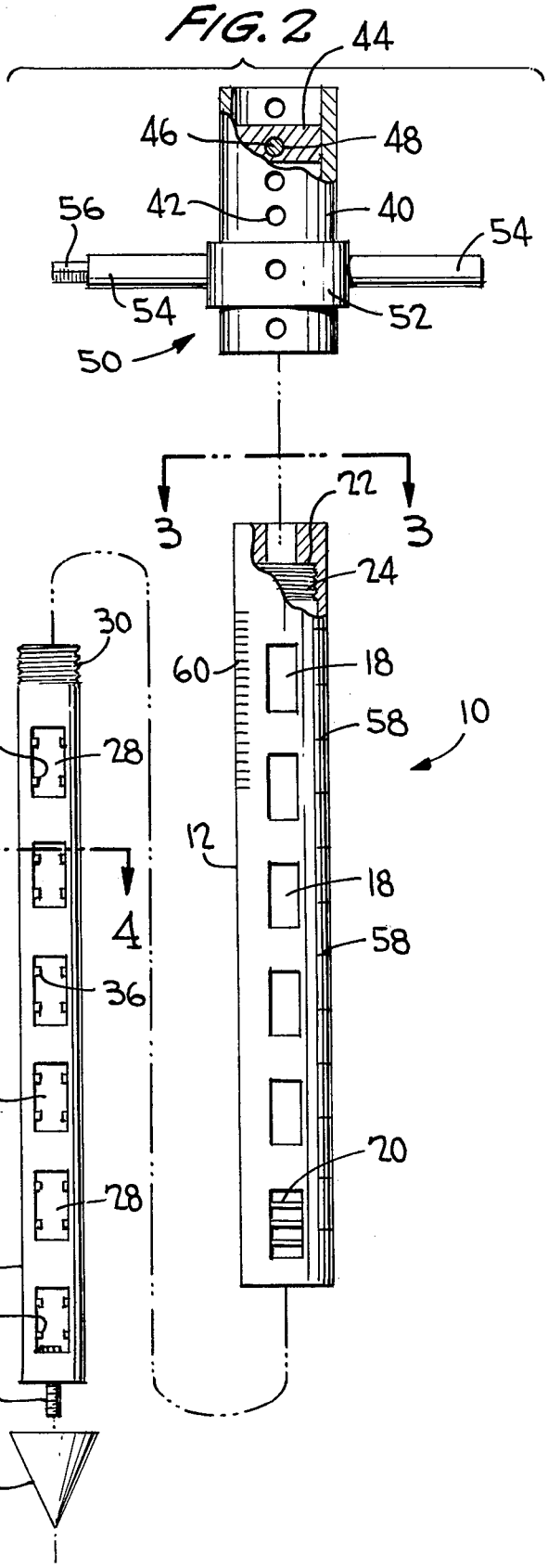
FIG. 2 is a side, exploded view of the device shown in FIG. 1.

Referring now to FIGS. 1 and 2, shown is device 10 in accordance with the present invention which includes tubular member 12, pointed conical member 14 at one end of the tubular member, and pounder 16 at the other end of the tubular member. The side walls of tubular member 12 are provided with a series of rectangularly-shaped windows 18, preferably equally spaced from each other. Each window 18 may have one or more horizontally extending bars 20 extending across the window as is shown in the lowermost window of tubular member 12. The upper end of tubular member 12 is partially closed by inwardly projecting circumferential lip 22 and the inner surface of the tubular member immediately below the lip is provided with internal threads 24.

Figure 3:
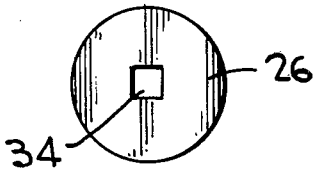
FIG. 3 is a top view of the shaft shown in FIG. 2.
Figure 4:
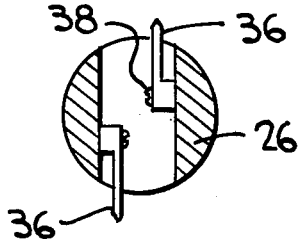
FIG. 4 is a cross-sectional view of the shaft taken along line 4—4 of FIG. 2.
Figure 5:
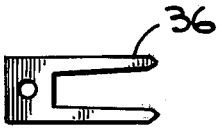
FIG. 5 is a detailed side view of a tooth as shown in FIG. 4.

Located within tubular member 12 is elongated cylindrical shaft 26 having a series of compartments 28 along its longitudinal axis which correspond in size and location to windows 18 in the tubular member. As is best shown in FIG. 4, each compartment 28 extends completely through shaft 26. The upper end of shaft 28 is provided with external threads 30 which are adapted to engage with threads 24 of tubular member 12. Extending from the lower end of shaft 26 is bolt 32 which engages a threaded hole (not shown) within conical member 14 so as to securely attach the conical member to the shaft. As is shown in FIG. 3, the upper end of shaft 26 is provided with rectangular axial hole 34 of a depth sufficient to accommodate a suitable tool.

As is apparent, when device 10 is assembled, shaft 26 fits closely within tubular member 12 and when threads 24 and 30 are almost fully engaged, each window 18 is aligned with one compartment 28 of the shaft. Upon rotation of shaft 26 relative to tubular member 12 of about one-quarter turn, compartments 28 in the shaft will become closed by the side wall of the tubular member.

As is best shown in FIG. 4, each compartment 28 of shaft 26 contains one or more spring-like teeth 36 adapted to extend from each side of the compartment. Each tooth 36 is attached to the inner wall of compartment 28 by a fastener 38 such as a screw, bolt or the like. Teeth 36 extending from opposite sides of compartment 28 must be located on opposite side walls so that when tubular member 12 is rotated clockwise relative to shaft 26 to close the compartments, the ends of teeth 36 are forced inwardly into the compartment. If the location of teeth 36 were reversed, then shaft 26 would have to be rotated relative to tubular member 12 in the opposite direction.

Pounder 16 is adapted to fit over the upper end of tubular member 12 and includes hollow cylindrical member 40 having an internal diameter approximating the external diameter of the tubular member. Cylindrical member 40 also has a plurality of holes 42 on each side of the member and which extend along its longitudinal axis. Disc-shaped adjustable weight 44 of a diameter approximating the internal diameter of cylindrical member 40 is located within the cylindrical member and held in that position by L-shaped pin 46 passing through a pair of holes 42 and a bore 48 in the weight. Fixedly attached to the external surface of cylindrical member 40 is handle 50 comprising ring portion 52 and extending arm portions 54. Handle 50 may be attached to cylindrical member 40 by means such as welding or the like. The end of one of arm portions 54 is formed into square shaped tool 56 of a size sufficient to snugly fit within rectangular hole 34 of shaft 26.

Preferably, tubular member 12, conical member 14, pounder 16 and shaft 26 of sampling device 10 are of high strength steel of dimensions sufficient to withstand pounding forces. Teeth 36 are of a resilient material such as a high strength polymer or tempered steel. The overall length of device 10 is not critical, however, a length of about 3 to 7 feet is satisfactory for sampling most placer deposits. Similarly, the diameter of the device is not critical but the smaller the diameter, the easier it is to force the device into a deposit.

To utilize device 10 so as to obtain a plurality of samples from a deposit, the device is assembled as shown in FIG. 1 with weight 44 of pounder 16 resting on the top surface of tubular member 12 and with the tubular member and shaft 26 rotated relative to each other such that compartments 28 are closed by the side walls of the tubular member. When threads 30 of shaft 26 are screwed tightly into threads 24 of tubular member 12, compartments 28 are closed, the top of the shaft is in engagement with lip 22 of the tubular member, and the bottom of the tubular member is brought tightly against pointed member 14. Thus threads 24 and 30 are not subjected to shock and pressure as device 10 is driven into a deposit.

Conical member 14 of device 10 is then placed on the surface of the deposit to be sampled and the device forced into the deposit by striking repeated blows on the exposed or upper end of tubular member 12 with a sledgehammer or preferably with pounder 16. As device 10 progresses into the deposit by use of pounder 16, it may be advantageous to occasionally remove the pounder and change the location of weight 44 within cylindrical member 44 by removing pin 46 and having it pass through another pair of holes 42 so as to maintain handle 50 of pounder 16 at convenient height from the surface of the deposit. Since handle 50 of pounder 16 is preferably mounted near one end of cylindrical member 40, the pounder can also be inverted relative to tubular member 12 to provide further height adjustment for the handle of the pounder relative to the end of tubular member 12. Clearly, pounder 16 could be made of a greater length relative to tubular member 12 than that shown in the drawings if more height adjustment of the pounder was considered desirable.

Once device 10 has been driven to the desired depth by use of pounder 16, the pounder is removed and a tool such as an extended ratchet type wrench or tool 56 on arm portion 54 of the pounder is inserted into the end of tubular member 12 to engage rectangular hole 34 in shaft 26. Upon appropriate rotation of shaft 26 by the tool, windows 18 of tubular member 12 become aligned with compartments 28 and consequently teeth 36 are allowed to project into the surrounding deposit. The material of the deposit adjacent to window 18 and compartment 28, being primarily sand or gravel, will tend to flow into the compartments once the windows are aligned with the compartments. Teeth 36 tend to facilitate the collection of a deposit sample in each compartment, particularly in those deposits which are moist or tightly packed. Striking device 10 with several blows while windows 18 are aligned with compartments 28 may also help to collect a sample of sufficient volume. Bars 20 across each window 18 help prevent larger rocks or minerals from partially entering compartments 28 which could block further rotation of shaft 26 relative to tubular member 12.

After the samples have been collected in each compartment 28, tool 56 or the like is again used to rotate shaft 26 and thereby close compartments 28 to retain the collected samples. Shaft 26 must be rotated in a direction opposite to that used to open compartments 28 so that teeth 36 are inwardly biased and thereby caused to retract within the compartments.

Before removing device 10 from the deposit, the depth of insertion of the device should be recorded by noting which of the depth indicator marks 58 on the side of the tubular member 12 is closest to the surface of the deposit.

Figure 6:
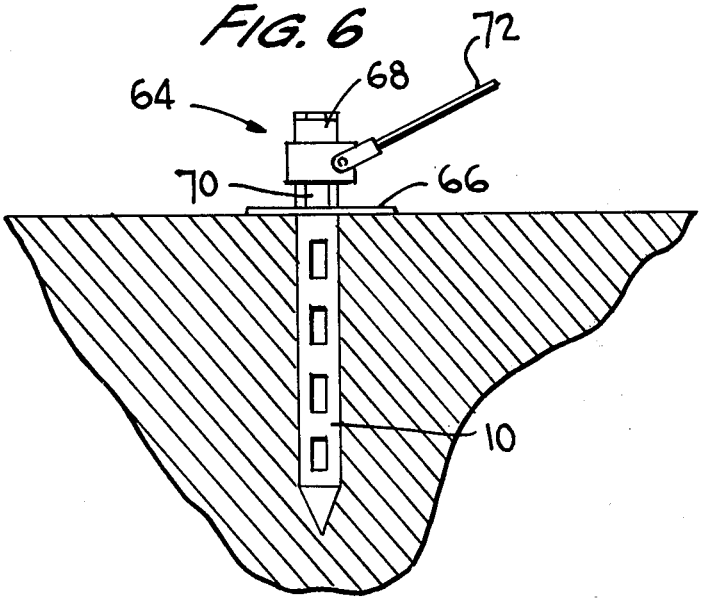
FIG. 6 illustrates a jack type apparatus for removing the sampling device from a deposit.

Device 10 with pounder 16 removed is then extracted from the deposit, preferably by automobile bumper jack type apparatus 64 as shown in FIG. 6. Jack apparatus 64 sequentially engages notches 60 on the side surface of tubular member 12 and thereby lifts device 10 from the deposit. Apparatus 64 includes base 66 of sufficient area, preferably of 10–12 inches in diameter, so that the apparatus will not tend to sink when used on sand or other soft surfaces. Support members 70 attached to base 66 elevate the jacking mechanism of apparatus 64 from the deposit surface to provide sufficient space for the operation of the apparatus.

The specific jacking mechanism of apparatus 64 contained in member 68 surrounding device 10 is not shown in detail as many suitable mechanisms are available in the marketplace and such can be adapted for use with an apparatus without significant modifications. For convenience and also to reduce the overall weight and bulk in transporting device 10 and associated jack apparatus 64, arm portions 54 of handle 50 of pounder 16 may be used as the operating lever for the jack apparatus in lieu of the removable bar 72 shown in the drawing.

Upon removal of device 10 from the deposit by apparatus 64 or the like, tool 56 is again utilized to open compartments 28 and the various samples obtained are then analyzed for the presence of valuable minerals by methods such as panning or the like. If valuable concentrations of minerals have been found in the samples, further investigation by conventional prospecting methods are then utilized. If, however, the samples prove to be negative, a new location in the deposit is selected and the operation of the device is then repeated.

Thus, a sampling device according to the present invention provides a simple and efficient means for a prospector to sample placer deposits for the presence of valuable concentrations of minerals. The device can be easily operated by one person and provides valuable information, not only as to the presence of minerals, but also the depth at which these minerals are located in the deposit.

While the present invention has been described with reference to a particular embodiment thereof, it will be understood that numerous modifications may be made by those skilled in the art without actually departing from the spirit and scope of the invention as defined in the appended claims.

I claim:

1. A sampling device adapted for use by an individual in obtaining a plurality of samples from a mineral deposit, the device comprising a tubular member having a plurality of windows extending along its longitudinal axis, a rotatable shaft removably mounted within the tubular member having a plurality of compartments, each of said plurality of compartments being capable of aligning with one of said plurality of windows of the tubular member, each of said compartments also having at least one spring-like solid tooth capable of extending from the compartment and through a window when the compartments and windows are aligned, and a pointed conical member attached to one end of said rotatable shaft so as to allow said shaft and said tubular member to be forced into a mineral deposit by force applied at the opposite end by an individual.

2. A sampling device according to claim 1 wherein the tubular member includes internal threads engaging external threads on the rotatable shaft.

3. A sampling device according to claim 1 wherein each window of the tubular member includes one or more bars thereacross.

4. A sampling device according to claim 1 wherein said opposite end of the rotatable shaft includes means for engagement with a tool.

5. A sampling device according to claim 1 wherein the external surface of the tubular member includes means for engagement with a jack type device.

6. A sampling device according to claim 1 further including a pounder comprising a hollow cylindrical member capable of fitting over the tubular member and an adjustable weight located within the cylindrical member for engagement with the end of the tubular member.

7. A sampling device according to claim 6 wherein the pounder includes a handle comprising at least one arm portion.

8. A sampling device according to claim 7 wherein one of the arm portions of the handle is in the shape of a tool capable of engaging means provided at the end of the shaft to cause rotation of the shaft within the tubular member.

9. A sampling device according to claim 1 wherein each of said compartments in said rotatable shaft extend completely therethrough.

* * * * *